US010219629B2

(12) United States Patent
Serena

(10) Patent No.: US 10,219,629 B2
(45) Date of Patent: Mar. 5, 2019

(54) DEVICE FOR AXIAL TRANSLATION OF ARMRESTS, IN PARTICULAR FOR OFFICE CHAIRS

(71) Applicant: Brado S.p.A., Valdobbiadene (IT)

(72) Inventor: Stefano Serena, Valdobbiadene (IT)

( * ) Notice: Subject to any disclaimer, the term of this patent is extended or adjusted under 35 U.S.C. 154(b) by 0 days.

(21) Appl. No.: 15/934,466

(22) Filed: Mar. 23, 2018

(65) Prior Publication Data

US 2018/0279787 A1 Oct. 4, 2018

(30) Foreign Application Priority Data

Apr. 3, 2017 (IT) ..... 102017000036472

(51) Int. Cl.
*A47C 7/54* (2006.01)
*A47C 1/03* (2006.01)
*A47C 9/02* (2006.01)

(52) U.S. Cl.
CPC ..... *A47C 7/54* (2013.01); *A47C 1/03* (2013.01); *A47C 9/02* (2013.01)

(58) Field of Classification Search
CPC ..... A47C 7/54; A47C 1/03; A47C 9/02
USPC ..... 297/411.35, 411.37
See application file for complete search history.

(56) References Cited

U.S. PATENT DOCUMENTS 5,927,811 A * 7/1999 Tseng ..... A47C 1/03 297/411.35 X
5,931,537 A * 8/1999 Gollin ..... A47C 1/03 297/411.35 X
6,017,091 A * 1/2000 Cao ..... A47C 1/03 297/411.35
6,074,012 A * 6/2000 Wu ..... A47C 1/03 297/411.35 X
6,619,746 B2 * 9/2003 Roslund, Jr. ..... A47C 1/03 297/411.35 X
7,159,947 B1 * 1/2007 Lee ..... A47C 1/03 297/411.35

(Continued)

FOREIGN PATENT DOCUMENTS

| | | |
|---|---|---|
| DE | 10133132 | 2/2002 |
| JP | 4185623 | 11/2008 |
| KR | 20110031589 | 3/2011 |

OTHER PUBLICATIONS

Italian Patent and Trademark Office, Search Report dated Nov. 29, 2017.

*Primary Examiner* — Rodney B White
(74) *Attorney, Agent, or Firm* — Themis Law

(57) ABSTRACT

An armrest for office chairs includes a pad and a sleeve coupled to the chair structure. A tray, having longitudinal strips with seats at their ends, is integral with the sleeve and houses a play recovery element having externally protruding appendages, and the play recovery element has two central curved portions with opposite concavities. The pad has two internally protruding bands, each having a central opening and forming end seats with the transverse edges of the pad; and a longitudinal relief with grooved side walls and two transverse ribs. The play recovery element has elastically inclined flaps and further has the appendages inserted into the seats of the tray. The side walls of the longitudinal reliefs engage the curved portions, and the two transverse ribs of the pad abut the inclined elastic flaps of the play recovery element to prevent the tray from disengaging when inserted into the pad.

2 Claims, 5 Drawing Sheets

(56) References Cited

U.S. PATENT DOCUMENTS 7,188,907 B1 * 3/2007 Lai ..... A47C 1/03 297/411.35
7,201,449 B2 * 4/2007 Tsai ..... A47C 1/03 297/411.37 X
7,341,313 B2 * 3/2008 Bedford ..... A47C 1/03 297/411.37 X
7,367,628 B1 * 5/2008 Tsai ..... A47C 1/03 297/411.35
7,387,341 B1 * 6/2008 Tsai ..... A47C 1/03 297/411.35
7,559,609 B2 * 7/2009 Tsai ..... A47C 1/03 297/411.35
7,641,284 B2 * 1/2010 Jones ..... A47C 1/03 297/411.35 X
7,837,269 B2 * 11/2010 Bock ..... A47C 1/03 297/411.35
8,061,778 B2 * 11/2011 Machael ..... A47C 1/03 297/411.35
8,403,417 B2 * 3/2013 Huang ..... A47C 1/03 297/411.35
8,474,914 B2 * 7/2013 Chen ..... A47C 7/68 297/411.35
8,960,801 B2 * 2/2015 Hu ..... A47C 7/54 297/411.37 X
9,004,603 B1 * 4/2015 Wang ..... A47C 1/03 297/411.35
9,113,711 B2 * 8/2015 Bock ..... A47C 1/03
9,345,333 B2 * 5/2016 Gorgi ..... A47C 7/54
2005/0184574 A1 * 8/2005 Tsai ..... A47C 1/03 297/411.37
2012/0119557 A1 * 5/2012 Fang ..... A47C 1/03 297/411.35
2013/0264855 A1 * 10/2013 Huang ..... A47C 1/03 297/411.35
2014/0145490 A1 * 5/2014 Chen ..... A47C 1/03 297/411.37
2018/0049552 A1 * 2/2018 Tsai ..... A47C 1/03

* cited by examiner

DEVICE FOR AXIAL TRANSLATION OF ARMRESTS, IN PARTICULAR FOR OFFICE CHAIRS

FIELD OF THE INVENTION

The present invention relates to a device for axial translation of armrests, in particular for office chairs.

BACKGROUND OF THE INVENTION

Armrests are known consisting of a substantially L-shaped support bracket, with the end of the horizontal arm secured to the frame of the chair and with the top end of the vertical arm having a pad (armrest) for the arm of the user to rest on.

It is the object of the invention to provide a device for the axial translation of the pad (armrest) which allows to easily and comfortably adjust the position of the pad with respect to the L-shaped bracket.

Such an object is achieved, in accordance with the invention, by means of a device for the axial translation of a chair armrest as described hereinafter

BRIEF DESCRIPTION OF THE DRAWINGS

The present invention is further clarified below in a preferred embodiment thereof, given purely by way of explanation and not by way of limitation with reference to the accompanying drawings, in which.

DETAILED DESCRIPTION OF EMBODIMENTS OF THE INVENTION

Figure 1:
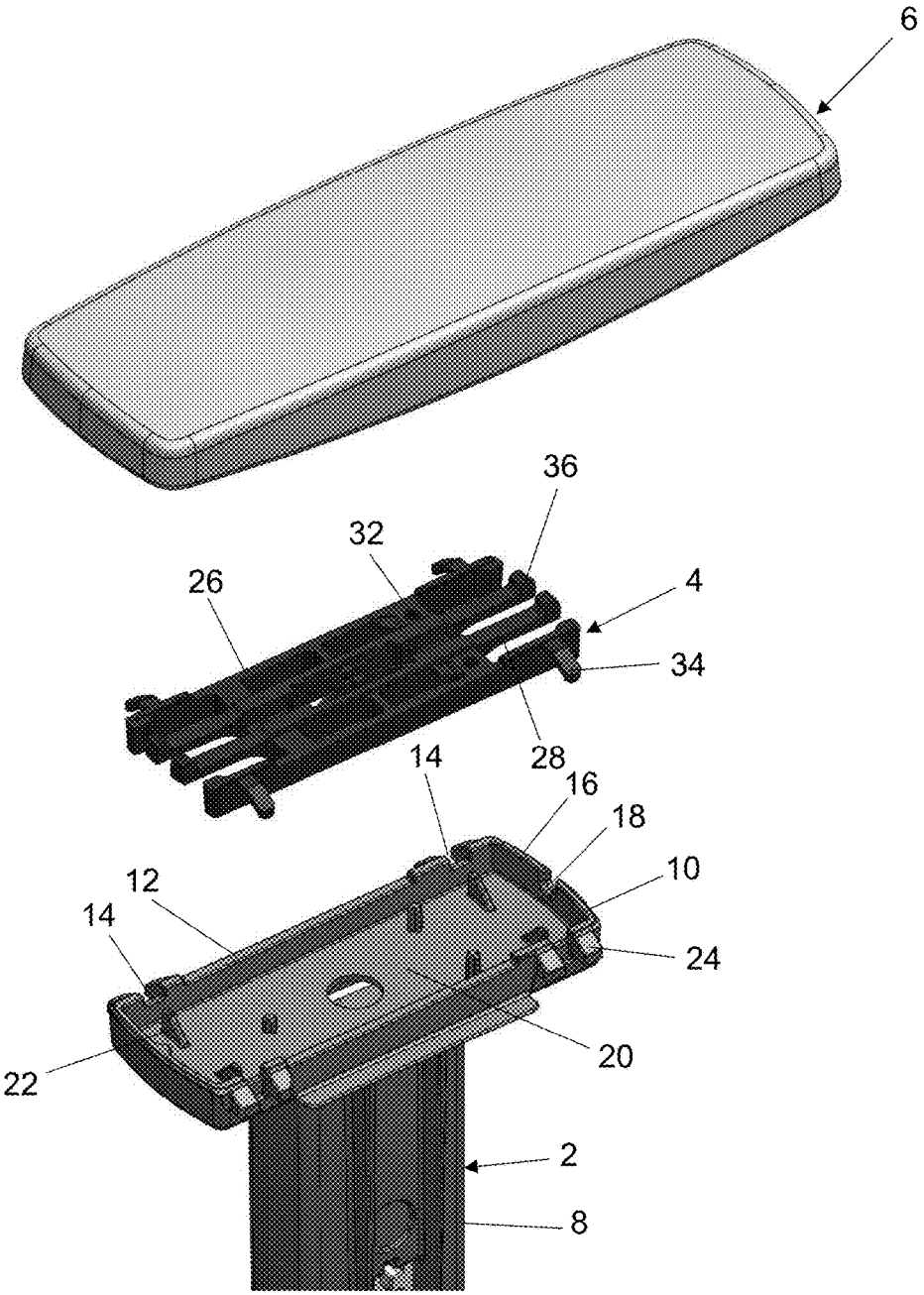
FIG. 1 shows a top exploded perspective view of the device for the axial translation of an armrest in accordance with the invention.
Figure 2:
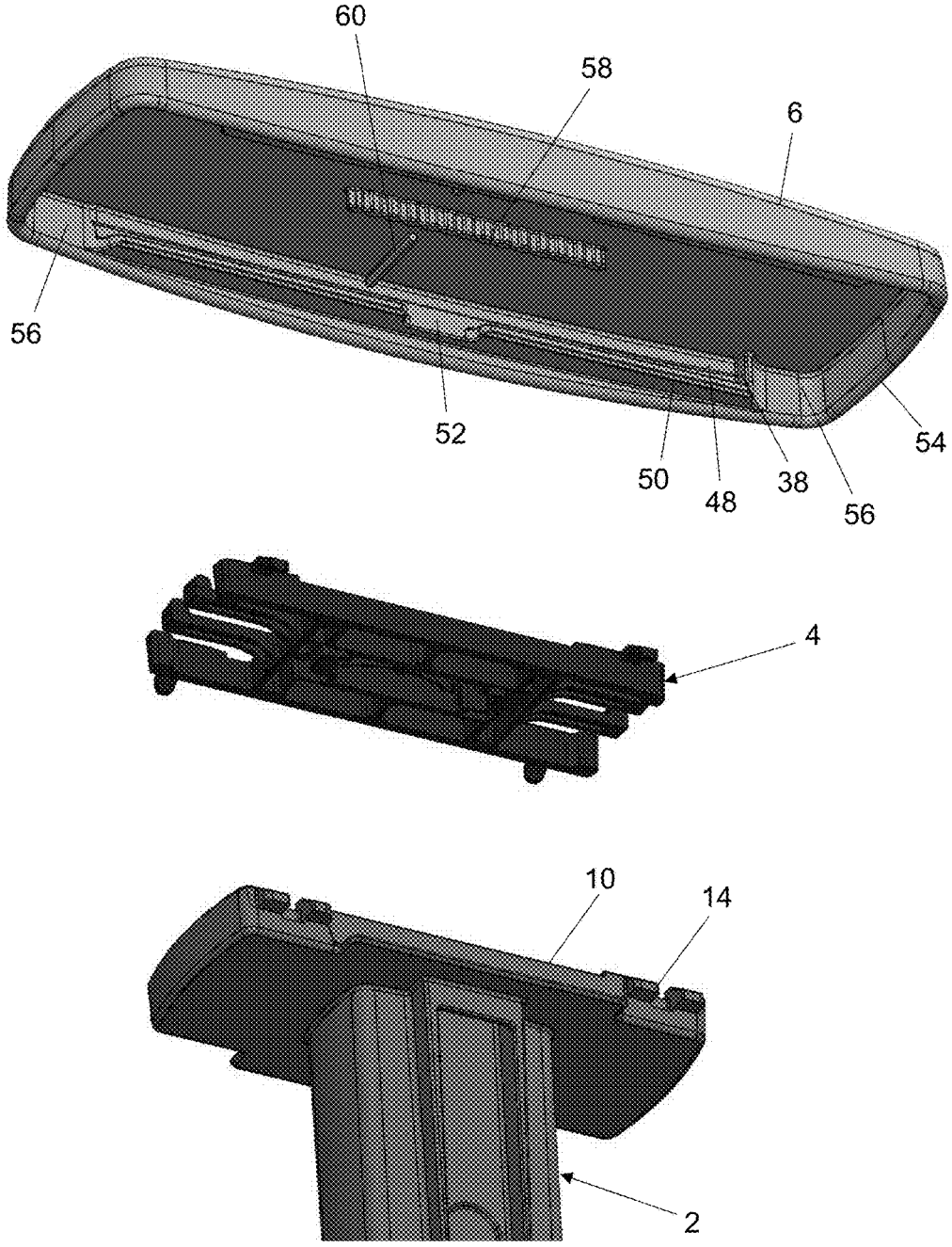
FIG. 2 shows a bottom exploded perspective view thereof.
Figure 3:
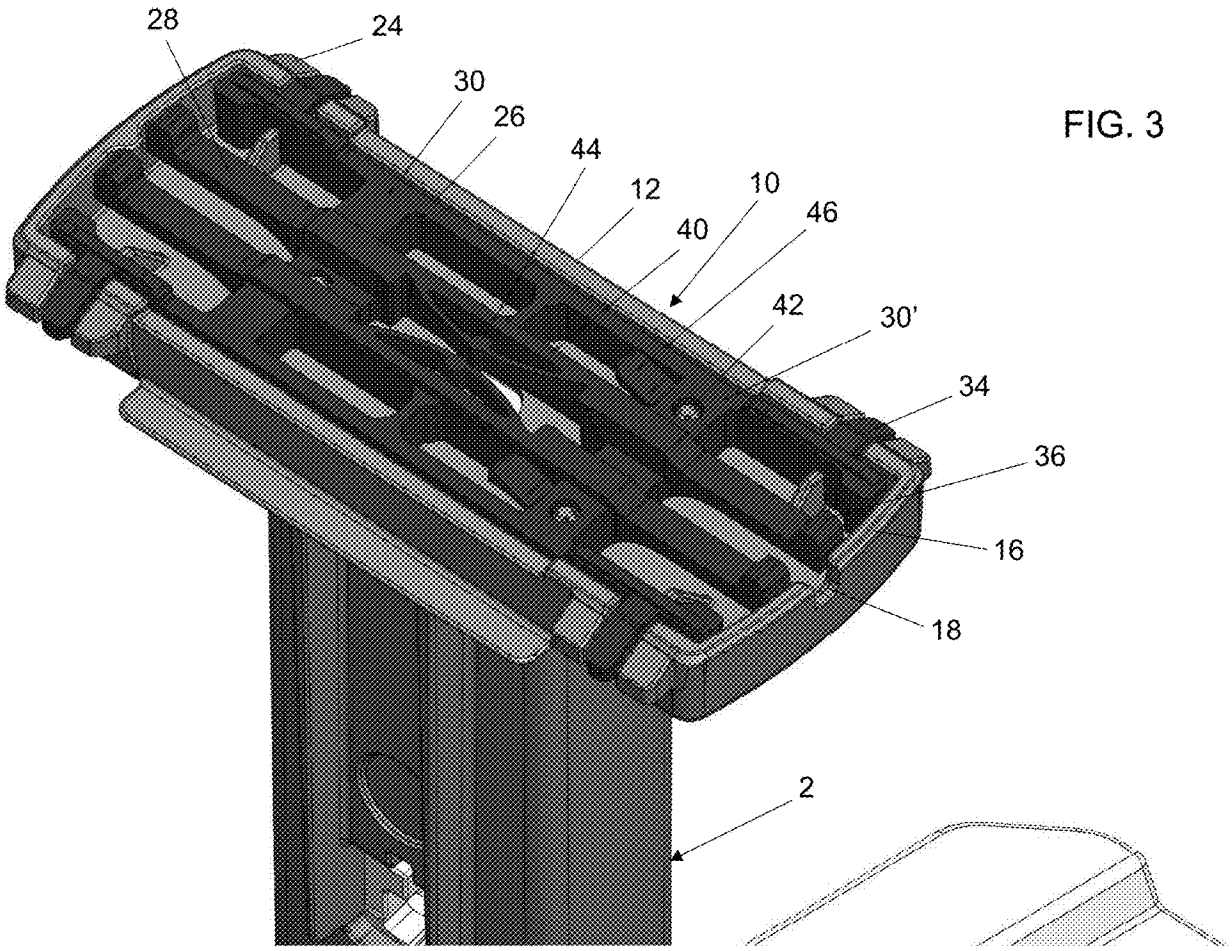
FIG. 3 shows the play recovery element inserted into the tray.
Figure 4:
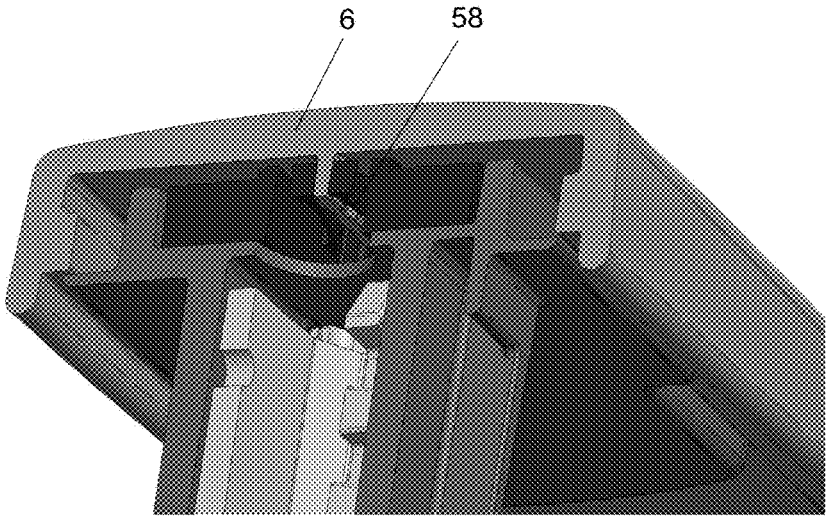
FIG. 4 shows the device in cross-section.
Figure 5:
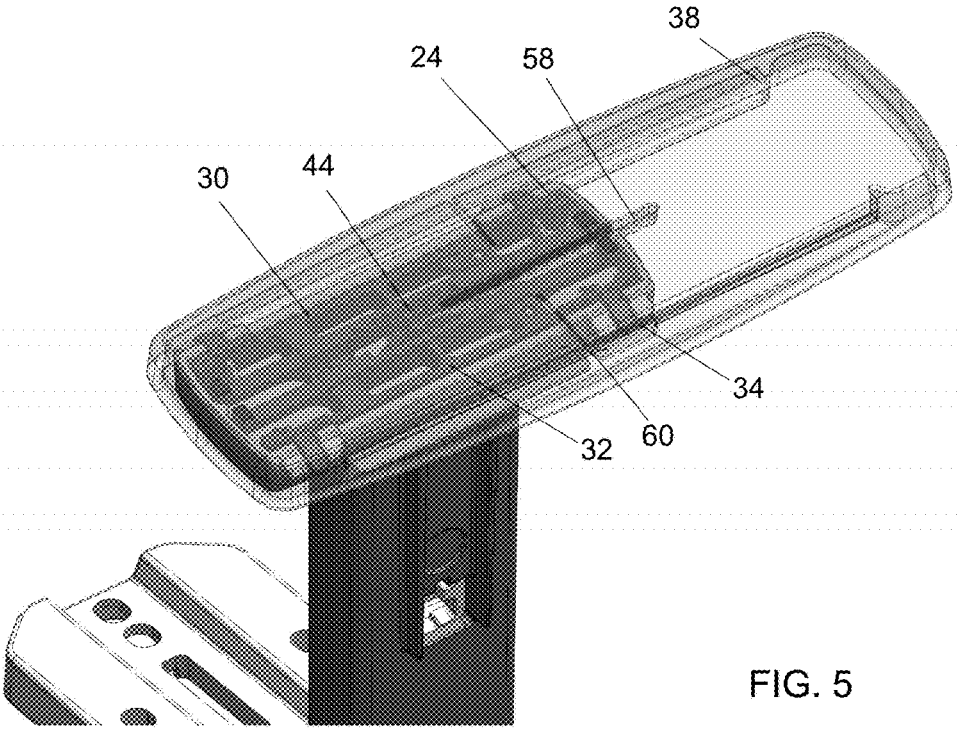
FIGS. 5, 6 and 7 show the steps of inserting the sleeve with the play recovery element into the pad.
Figure 6:
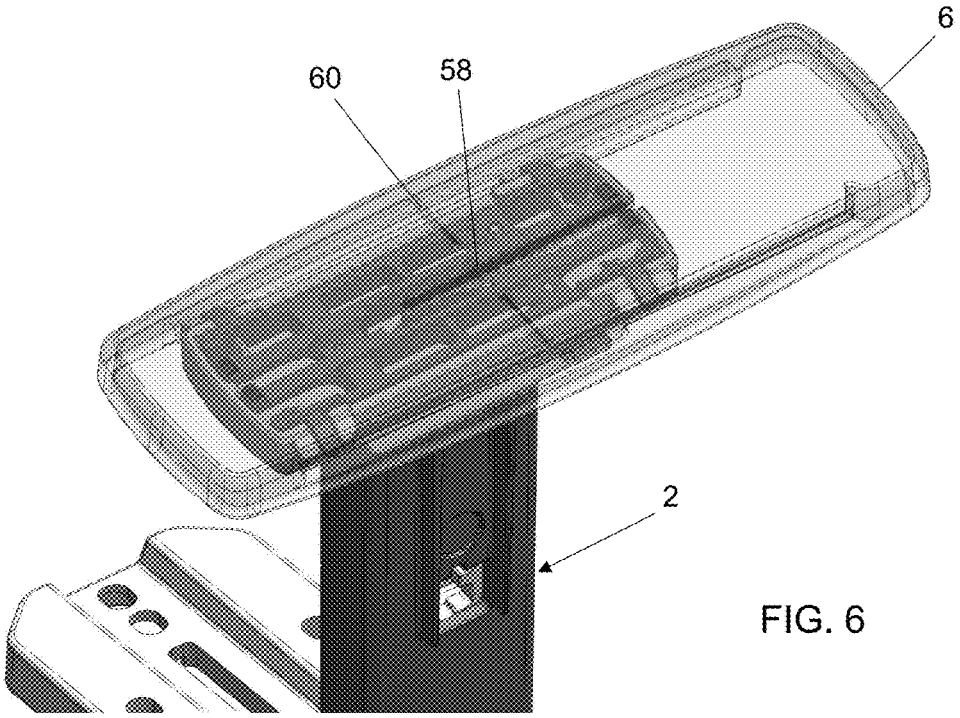
Figure 7:
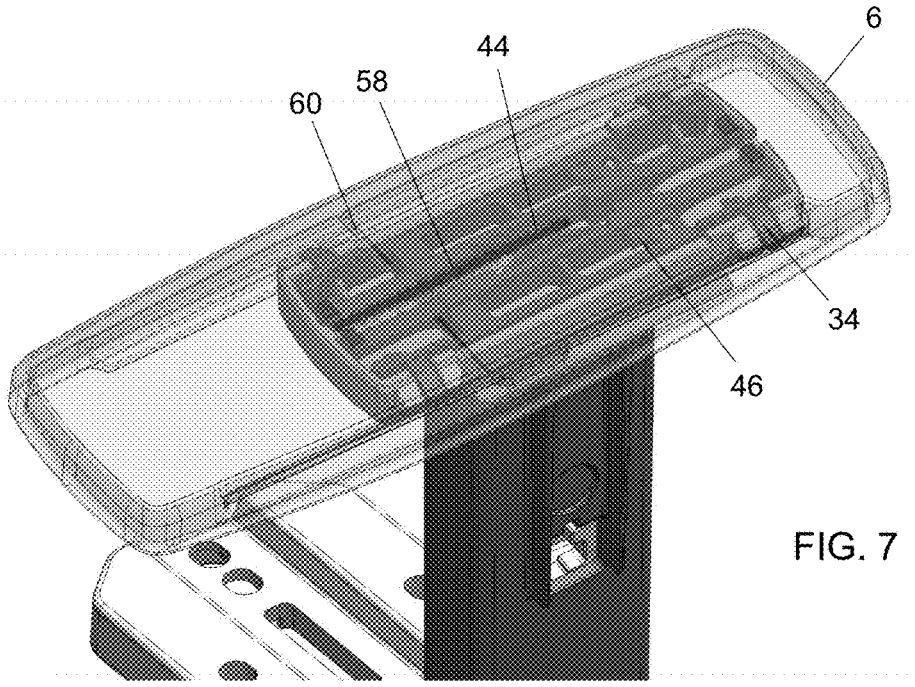

As shown in the figures, the device for axial translation of the armrest (pad) in accordance with the invention substantially comprises:

a sleeve 2, adjustable in any manner with respect to an L-shaped bracket integral with the chair seat structure, a play recovery element 4, and a pad or armrest 6.

The sleeve 2 comprises a tube 8 at the top end thereof a tray 10 is integral, the longitudinal vertical strips 12 thereof have four seats 14 and a transverse strip 16 has one seat 18.

From the internal top surface 20 of the tray 10 four substantially right triangle-shaped appendages 22 branch off, which face the seats 14.

Furthermore, flaps 24 branch off from the vertical edges 12 of each seat 14.

The play recovery element 4 consists of a frame which may be housed in the tray 10 and is formed by two first external longitudinal bars 26 and by two second internal longitudinal bars 28 connected to one another by crosspieces 30, 30'.

In particular:

the longitudinal edges 32 of the external bars 26 extend into two pairs of appendages 34 folded downwards with a distance from one another corresponding to that of the seats 14, the ends of the internal longitudinal bars 28 are provided with thickenings 36 facing upwards, holes 42 are provided for in the crosspieces 32, the function thereof will be clarified below, two curved elements 40, centrally having two substantially hemispherical or semi-cylindrical facing portions 44, branch off from the internal longitudinal bars 28, two elastic tabs inclined upwards 46 branch off from the crosspiece 30'.

The pad 6 consists of a semi-blind body provided, at the longitudinal walls 48, with two internally protruding bands 50 having a central seat 52 and forming, with the transverse walls 54, seats 56.

The internal surface has a longitudinal relief 58 with grooved side walls.

Furthermore, the internal surface of the pad has two transverse ribs 60.

The distance between the seat 56 and the seat 52 corresponds to the distance between the flaps 34 of the play recovery element. Furthermore, one end of the flaps 50 is provided with an end-of-stroke appendage 38.

The operation of the device in accordance with the invention is as follows: firstly, the play recovery element is inserted into the tray 10, so that the appendages 34 are inserted into the seats 14 and, by means of orientation pins (not shown in the drawings) which are inserted into the holes 42, is assembled thereto.

Subsequently, the tray, with the play recovery element inserted therein, is inserted inside the pad 6 for inserting the flaps 24 into the openings 52 and 56. Once the tray is inserted, it is slid inside the semi-blind body so that the relief 58 is inserted between the curved elements 40, and the hemispherical or semi-cylindrical portions 44 selectively engage in the grooves.

Following this sliding of the pad, the inclined flaps 46 elastically pass over the transverse ribs 60 and the backward return thereof is prevented by the contrast with the transverse ribs 60.

The adjustment of the pad with respect to the armrest, however, may be continued by sliding the longitudinal relief 58 between the two curved portions 40 until the flaps 24 interfere with the end-of-stroke appendages 38.

The invention claimed is:

1. An armrest for office chairs comprising:

a pad for supporting an arm of a user; and a sleeve of an L-shaped bracket integral with a chair structure, wherein:

a tray, having longitudinal strips, with seats at ends of the longitudinal strips, is integral a the top end of the sleeve, a play recovery element being housed in said tray and having appendages externally protruding from said tray, said play recovery element being centrally provided with two curved portions having opposite concavities and substantially semi-cylindrical portions provided in central position;

the pad consists of a semi-enclosed body provided with two internally protruding bands at longitudinal walls thereof, each band having a central opening and forming two end seats with transverse edges of the pad, the internal surface of said pad having a longitudinal relief with grooved side walls and two transverse ribs;

said play recovery element is provided with two elastically inclined flaps;

said play recovery element has the appendages inserted into the seats of the tray;

the side walls of the longitudinal relief engage the substantially semi-cylindrical portions of the curved elements; and the two transverse ribs of the pad constitute an abutment element for the inclined elastic flaps of said play recovery element to prevent the tray from disengaging when inserted into the pad.

2. A device according to claim 1, wherein said tray and said play recovery element are made as separate pieces.

* * * * *